United States Patent [19]

Curtze

[11] Patent Number: 4,704,987

[45] Date of Patent: Nov. 10, 1987

[54] PAINTING MASK AND FIXTURE

[75] Inventor: Edward W. Curtze, Perrysburg, Ohio

[73] Assignee: Libbey-Owens-Ford Co., Toledo, Ohio

[21] Appl. No.: 844,578

[22] Filed: Mar. 27, 1986

[51] Int. Cl.[4] ..... B05C 13/00; B05C 13/02

[52] U.S. Cl. ..... 118/500; 118/503; 15/268; 206/448; 220/4 B; 269/296; 269/302

[58] Field of Search ..... 118/500, 501, 502, 503; 15/268; 206/448, 557; 134/120, 172, 201; 220/4 B, 4 E; 269/287, 296, 302; 51/217 R, 277; 427/284

[56] References Cited

U.S. PATENT DOCUMENTS 1,318,007 10/1919 Gau ..... 220/4 E

*Primary Examiner*—Sam Silverberg
*Assistant Examiner*—Terry J. Owens
*Attorney, Agent, or Firm*—Marshall & Melhorn

[57] ABSTRACT

A fixture for supporting and masking a portion of a window assembly during a painting operation includes a lower cover pivotally attached to an upper cover for movement between an open position and a closed position. In the open position, a window assembly can be inserted between the covers and in the closed position the covers mask a glass sheet and expose a gasket of the window assembly for painting. The upper and lower covers can be formed with a generally planar floor surrounded by upstanding walls having recessed portions formed in the sidewalls dimensioned to retain and seal the glass sheet. The lower cover can be hingedly connected to a mounting block for approximately 180° of rotation to expose both sides of the extending gasket to a paint spray apparatus. A latching mechanism can be provided to maintain the upper and lower portions in the closed position during the painting operation. In an alternate embodiment, one of the covers can be a planar sheet and a handle can be provided thereon to assist in the rotation of the fixture about the mounting block.

13 Claims, 5 Drawing Figures

PAINTING MASK AND FIXTURE

BACKGROUND OF THE INVENTION

The present invention relates generally to an article supporting and masking fixture and in particular to a fixture for supporting and masking portions of a window assembly during a painting operation.

In the prior art, there are many apparatuses and methods for retaining windows in the body of an automobile. In particular, where the sheet of glass is to be fixed in an opening, some form of adhesive is utilized to adhere the edge of the sheet of glass to the periphery of the opening and then clips and moldings are utilized to cover the joint between the glass and the vehicle body.

The prior art assembly methods are now being replaced by a method utilizing adhesive and a window assembly having its peripheral edge encapsulated in a preformed gasket. Thus, the new window assembly can be installed in an opening in a vehicle body utilizing adhesive without the requirement for any trim strips or other articles to cover the joint between the window assembly and the vehicle body. The preformed gasket can also be utilized along the edges of a movable window such as a window assembly for a side door in a vehicle. However, the gasket is typically formed of a urethane material which is sensitive to ultraviolet light. If the gasket were to remain exposed, it would soon begin to discolor and deteriorate. Thus, the exposed surface of the gasket is typically coated with a protective urethane based paint. The urethane based paint is compatible with the urethane gasket, but resists the detrimental effect of ultraviolet radiation.

Since the exposed surfaces of the gasket represent a very small portion of the total surface of the window assembly, there is created a problem of adequately supporting the window assembly during the painting operation while masking the surfaces which are not to be painted. Furthermore, since the paint is unhealthy for humans, the painting operation is typically performed by robots and the fixture must be designed so as to allow access by a painting robot to the surfaces to be painted.

SUMMARY OF THE INVENTION

The present invention relates to a supporting fixture and painting mask for a window assembly for use during a gasket painting operation. The fixture is formed as a hollow container having hingedly connected upper and lower covers between which the window assembly is placed. The container is dimensioned to mask predetermined areas and is provided with an aperture through which the gasketed portions of the window assembly extend to be exposed when the container is closed. If both sides of the gasket are to be painted, one of the halves of the container can be hinged to a stationery point such that the entire container can be rotated approximately 180° to expose the opposite side of the gasket to the painting apparatus. The container can be provided with a handle to assist in the movement between the two painting positions and a quick release latching mechanism can be utilized to maintain the two covers in the closed position during the painting operation.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
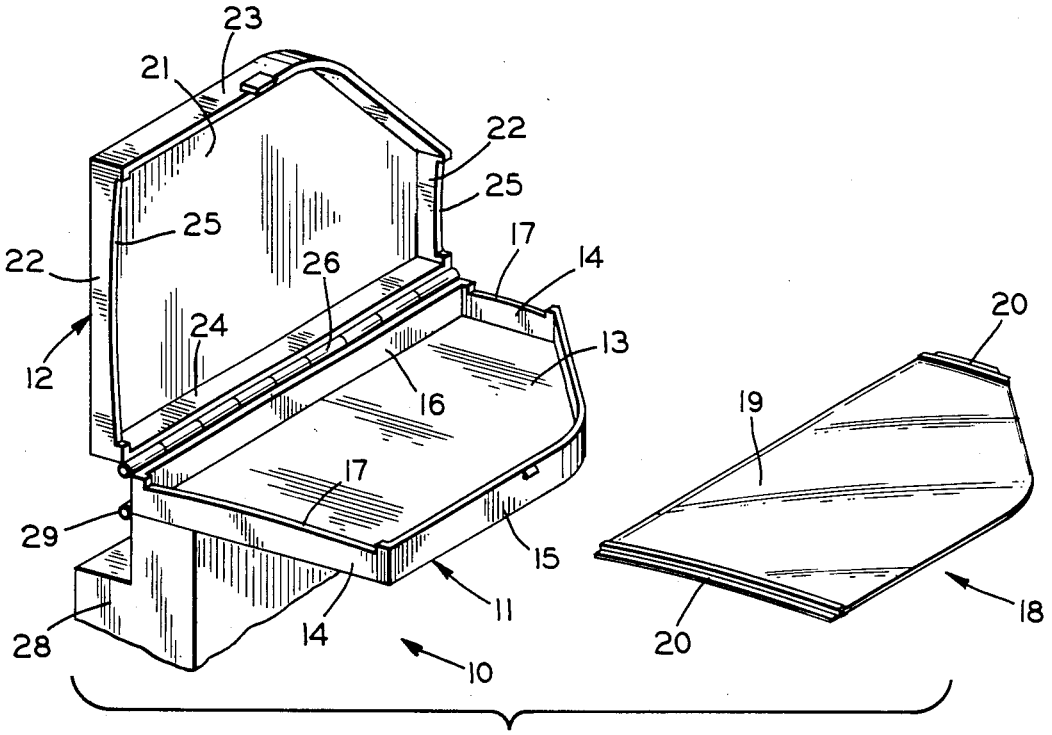
FIG. 1 is a perspective view of a painting mask and fixture according to the present invention and a window assembly for insertion into the fixture.
Figure 2:
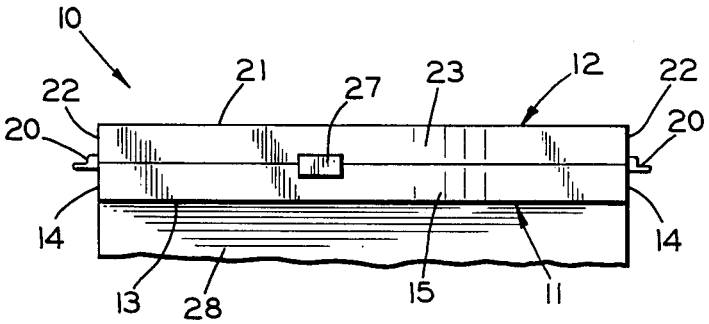
FIG. 2 is a front elevational view of the painting mask and fixture shown in FIG. 1.
Figure 3:
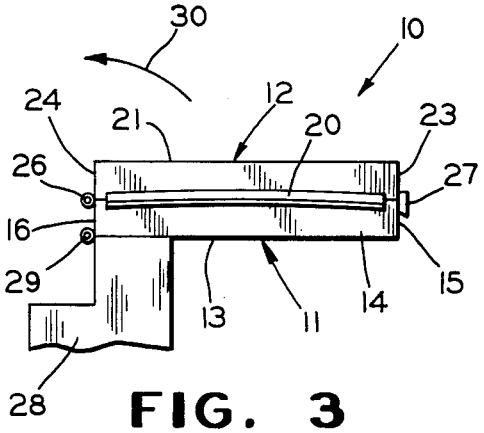
FIG. 3 is a side elevational view of the painting mask and fixture shown in FIG. 1.

There is shown in FIGS. 1 through 3 a painting mask and fixture 10 according to the present invention. The mask and fixture 10 is a box-like container structure having a lower half or cover 11 hingedly connected to an upper cover or half 12. The lower cover 11 includes a generally planar floor 13 of substantially rectangular form. A periphery of the floor 13 is surrounded by a generally upstanding wall including opposed sidewalls 14, front wall 15 and rear wall 16. The opposed sidewalls 14 each have a recessed portion 17 formed along an upper edge thereof. The lower cover 11 is dimensioned to receive a window assembly 18 including a glass sheet 19 having one or more gaskets 20 formed along a predetermined portion of its peripheral edges. The recessed portions 17 are dimensioned to accept that portion of the glass sheet 19 adjacent the gaskets 20 such that only the gasket 20 extends beyond the sidewall 14.

Similarly, the upper cover 12 of the container includes a generally planar floor 21 surrounded at its periphery by a pair of opposed sidewalls 22, a front wall 23 and a rear wall 24. Recessed portions 25 are formed in the outer edges of the sidewalls 22 and correspond to the recessed portions 17. The recessed portions 17 and 25 cooperate to seal against the opposed surfaces of the glass sheet 19 when the upper cover 12 and lower cover 11 of the container are closed together. Thus, in the closed condition, the mask and fixture 10 supports and masks the glass sheet 19 while exposing the gaskets 20 for painting.

The rear walls 16 and 24 are pivotly connected at their adjacent edges by a hinge member 26 to permit easy opening and closing of the fixture. The front walls 15 and 23 can be provided with a conventional latching mechanism 27 to prevent the lower cover 11 and upper cover 12 from separating during a painting operation.

If both sides of the gaskets 20 are to be painted, the lower cover 11 of the fixture can be connected to a mounting surface of a mounting block 28 by a second hinge member 29. Typically, after the upwardly facing surface of the gaskets 20 have been painted while the fixture is in the position shown in FIG. 3, the entire fixture can be rotated about the hinge 29 to expose the previously downwardly facing surfaces of the gaskets to a paint spray apparatus (not shown) positioned above the fixture. The direction of rotation is shown by the arrow 30.

Figure 4:
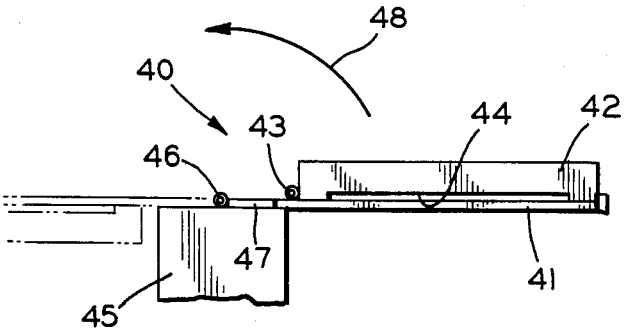
FIG. 4 is a side elevational view of an alternate embodiment of the painting mask and fixture according to the present invention.
Figure 5:
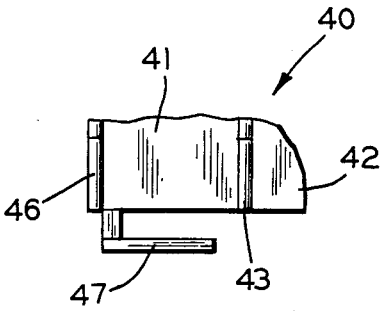
FIG. 5 is a fragmentary top plan view of an operating handle and hinges of fixture shown in FIG. 4.

In FIG. 4 there is shown an alternate embodiment of the mask and supporting fixture in accordance with the present invention. The mask and fixture 40 includes a generally planar lower cover 41 having a width approximately equal to the distance between the gaskets 20 on the window assembly 18. Pivotly attached to an upper surface of the lower cover 41 is an upper cover 42 similar to the upper cover 12 shown in FIGS. 1 through 3. The upper cover 42 is connected to the lower cover 41 by a hinge member 43. The upper cover 42 also includes a recessed portion 44 which is similar to the recessed portion 25 but is dimensioned to the thickness of the glass sheet to be masked. The lower cover 41 extends beyond the mounting point for the hinge member 43 and is pivotly attached to a mounting block 45 by a hinge member 46. A handle 47 extends outwardly from an edge of the lower cover 41 and can be utilized to rotate the fixture about the hinge member 46 in the direction of an arrow 48 so that both sides of a gasket can be exposed for painting.

Although the fixtures shown in the drawings are rectangular in shape, they can be of any suitable shape as may be required to mask the desired portions of a window assembly. Also, the hinge members 29 and 46 and the handle 47 can be attached to the first or upper cover rather than to the second or lower cover as shown in the drawings. If the glass sheet 19 has been formed or bent, the recesses 17, 25 and 44 and the lower cover 41 can be contoured to match the curvature of the glass.

In accordance with the provisions of the patent statutes, the principle and mode of operation of the present invention have been described in what is considered to represent the preferred embodiment. However, it should be understood that the invention may be practiced otherwise than as specifically illustrated and described without parting from its spirit or scope.

What is claimed is:

1. A fixture for masking and supporting a window assembly, the window assembly including a sheet of glass and at least one gasket formed on a periphery thereof, the fixture comprising:

a first cover having a floor and attached walls, said walls including a recessed portion;

a second cover having a floor; and hinge means for pivotly connecting said first and second covers for movement between an open position in which said covers are spaced apart to accept a window assembly and a closed position in which said covers are in contact to support and mask a glass sheet of a window assembly, the window extending through said recessed portion to expose a gasket formed on the glass sheet, said recessed portion of said walls sealingly engaging the window assembly.

2. The fixture according to claim 1 wherein said second cover includes walls attached to said second cover floor and a recessed portion formed in said second cover walls so that said recessed portions of said first and second cover walls cooperate to define an aperture through which the window assembly extends and to sealingly engage the window assembly.

3. The fixture according to claim 1 further comprising second means connected between one of said first and second covers and a mounting surface for pivotal movement of said first and second covers between first and second manufacturing operation positions.

4. The fixture according to claim 1 including latch means attached to said first and second covers for releasably securing said covers in said closed position.

5. The fixture according to claim 1 including a handle attached to one of said first and second covers.

6. A fixture for masking and supporting a window assembly, the window assembly including a sheet of glass and at least one gasket formed on a periphery thereof, the fixture comprising:

a first cover having a floor, a generally upstanding wall extending from a periphery of said floor, and a recessed formed in said wall for accepting a glass sheet;

a second cover, first hinge means pivotally connecting said first and second covers for movement between an open position in which a window assembly can be inserted between said first and second covers and a closed position in which a window assembly can be retained between said first and second covers, whereby in said closed position said covers mask a glass sheet of the window assembly and said recessed portion and said second cover form an aperture through which the glass sheet extends to expose a gasket of the window assembly to a manufacturing operation; and second hinge means connected between one of said first and second covers and a mounting surface for pivotal movement of said covers between first and second manufacturing operation positions.

7. The fixture according to claim 6 wherein said second cover has a floor, a generally upstanding wall extending from a periphery of said floor, and a recessed portion formed in said wall for cooperating with said recessed portion formed in said first cover wall to form said aperture.

8. The fixture according to claim 6 including latch means attached to said first and second covers for releasably securing said covers in said closed position.

9. The fixture according to claim 6 including a handle attached to one of said first and second covers.

10. A fixture for masking and supporting an article of manufacture comprising:

a first cover having a generally planar floor, a generally upstanding wall extending from a periphery of said floor, and a recessed portion formed in said wall for accepting an article;

a second generally planar cover;

first hinge means pivotally connecting said first and second covers for movement between an open position in which an article can be inserted between said first and second covers and a closed position in which an article can be retained between said first and second covers, whereby said covers mask a first portion of an article and said recessed portion and said second cover form an aperture through which the article extends to expose a second portion thereof to a manufacturing operation; and second hinge means connected between one of said first and second covers and a mounting surface for movement of said covers between first and second manufacturing operation positions.

11. The fixture according to claim 10 including latch means connected to said first and second covers for releasably securing said covers in said closed position.

12. The fixture according to claim 11 wherein said second cover includes a generally upstanding wall extending from a periphery of said second cover floor and a recessed portion formed in said second cover wall for cooperating with said first cover recessed portion to form said aperture.

13. The fixture according to claim 10 including at least two recessed portions formed in said wall and cooperating with said second cover to form at least two apertures through which the article extends to expose at least the second portion and a third portion of the article to a manufacturing operation.

* * * * *